US012616907B2

(12) United States Patent
Goergen et al.

(10) Patent No.: US 12,616,907 B2
(45) Date of Patent: May 5, 2026

(54) AMUSEMENT CONTENT PROCESSING SYSTEMS AND METHODS

(71) Applicant: Universal City Studios LLC, Universal City, CA (US)

(72) Inventors: Patrick John Goergen, Orlando, FL (US); Robert Jordan, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 511 days.

(21) Appl. No.: 18/075,125

(22) Filed: Dec. 5, 2022

(65) Prior Publication Data

US 2023/0182031 A1 Jun. 15, 2023

Related U.S. Application Data

(60) Provisional application No. 63/308,847, filed on Feb. 10, 2022, provisional application No. 63/287,602, filed on Dec. 9, 2021.

(51) Int. Cl.
*A63G 31/16* (2006.01)

(52) U.S. Cl.
CPC ..... *A63G 31/16* (2013.01)

(58) Field of Classification Search
CPC ..... A63G 31/16; A63G 7/00; A63G 31/00; G02B 27/017; G03B 21/14; G06F 3/016; G06F 3/16
See application file for complete search history.

(56) References Cited

U.S. PATENT DOCUMENTS

| | | | |
|---|---|---|---|
| 9,285,817 | B2 | 3/2016 | Wong |
| 9,928,660 | B1 | 3/2018 | Vembar et al. |
| 9,990,759 | B2 | 6/2018 | Mullins |
| 10,528,123 | B2 | 1/2020 | McCracken et al. |
| 10,586,395 | B2 | 3/2020 | Mullins et al. |
| 10,962,780 | B2 | 3/2021 | Ambrus et al. |
| 11,330,729 | B2 | 5/2022 | Graham et al. |

(Continued)

FOREIGN PATENT DOCUMENTS

| | | | |
|---|---|---|---|
| KR | 20190098472 | A | 8/2019 |
| WO | 2018165039 | A1 | 9/2018 |

OTHER PUBLICATIONS

PCT/US2022/052104 International Search Report and Written Opinion mailed Apr. 11, 2023.

(Continued)

*Primary Examiner* — Bryan Earles
(74) *Attorney, Agent, or Firm* — Fletcher Yoder, P.C.

(57) ABSTRACT

A content processing system for an amusement park attraction includes a processor configured to receive a data stream including one or more control instructions for output of amusement content. The processor is also configured to identify one or more operational characteristics of an accessory. The processor is also configured to, based on the one or more operational characteristics, effectuate modification of the data stream to generate a modified data stream including one or more updated control instructions for output of adjusted amusement content to be presented to a user via the accessory. The processor is also configured to transmit the modified data stream to the accessory.

20 Claims, 5 Drawing Sheets

(56) References Cited

U.S. PATENT DOCUMENTS

| | | | | |
|---|---|---|---|---|
| 2014/0240102 | A1* | 8/2014 | Kawash | G06F 3/017 340/12.5 |
| 2018/0218543 | A1 | 8/2018 | Vembar et al. | |
| 2018/0250589 | A1 | 9/2018 | Cossairt et al. | |
| 2019/0028691 | A1 | 1/2019 | Hinds et al. | |
| 2020/0151943 | A1 | 5/2020 | Navarrette et al. | |
| 2020/0215442 | A1 | 7/2020 | Leiba et al. | |
| 2020/0276510 | A1* | 9/2020 | Weston | G06F 3/011 |
| 2020/0327740 | A1 | 10/2020 | Frommhold et al. | |
| 2021/0268393 | A1 | 9/2021 | Smith | |
| 2024/0406232 | A1* | 12/2024 | Miller | H04L 67/02 |

OTHER PUBLICATIONS

AE Office Action for United Arab Emirates Application No. P2024-01434 mailed Oct. 30, 2025.

* cited by examiner

AMUSEMENT CONTENT PROCESSING SYSTEMS AND METHODS

CROSS-REFERENCE TO RELATED APPLICATIONS

This application claims priority to and the benefit of U.S. Provisional Application No. 63/287,602, filed Dec. 9, 2021, and titled "Amusement Content Processing Systems and Methods for Wearable Visualization Device," and U.S. Provisional Application No. 63/308,847, filed Feb. 10, 2022, and titled "Amusement Content Processing Systems and Methods," which are each hereby incorporated by reference in their entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks and/or theme parks may include various entertainment attractions, restaurants, and rides useful in providing enjoyment to guests. Areas of the amusement park may have different themes that are specifically targeted to certain audiences. For example, certain areas may include themes that are traditionally of interest to children, while other areas may include themes that are traditionally of interest to more mature audiences. Generally, such areas having themes may be referred to as an attraction or a themed attraction. Themed attractions may be established using fixed equipment, building layouts, props, decorations, and so forth, most of which may generally relate to a certain theme. In some cases, the immersive experience for guests of such attractions may be enhanced by augmenting the themes with additional features (e.g., visual elements, audible sounds, haptic feedback) that may be provided to the guest via an accessory (e.g., a wearable visualization device or a projector). It is recognized that it may be desirable to adjust presentation of such features in a manner that enhances guest experience of the attraction.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a content processing system for an amusement park attraction includes a processor configured to receive a data stream including one or more control instructions for output of amusement content. The processor is also configured to identify one or more operational characteristics of an accessory. The processor is also configured to, based on the one or more operational characteristics, effectuate modification of the data stream to generate a modified data stream including one or more updated control instructions for output of adjusted amusement content to be presented to a user via the accessory. The processor is also configured to transmit the modified data stream to the accessory.

In one embodiment, an attraction system includes an accessory having a sensor configured to acquire feedback indicative of an operational parameter of the accessory. The attraction system includes a server configured to generate a data stream including amusement content based at least in part on the feedback. The attraction system also includes a processing system configured to identify a type of the accessory and, based on the type of the accessory, effectuate modification of the data stream to generate a modified data stream including adjusted amusement content to be output to a user via the accessory. The processing system is also configured to transmit the modified data stream to the accessory.

In one embodiment, a method for operating a processing system of an attraction includes generating, via a server, a data stream of amusement content, where the data stream of amusement content is configured to be output by a first accessory for presentation to a user. The method also includes communicatively coupling a second accessory to the processing system and identifying, via the processing system, one or more operational characteristics of the second accessory. The method also includes, based on the one or more operational characteristics of the second accessory, effectuating modification of the data stream to generate a modified data stream including adjusted amusement content to be output by the second accessory for presentation to the user. The method also includes transmitting, via the processing system, the modified data stream to the second accessory.

Various refinements of the features noted above may be undertaken in relation to various aspects of the present disclosure. Further features may also be incorporated in these various aspects as well. These refinements and additional features may exist individually or in any combination.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
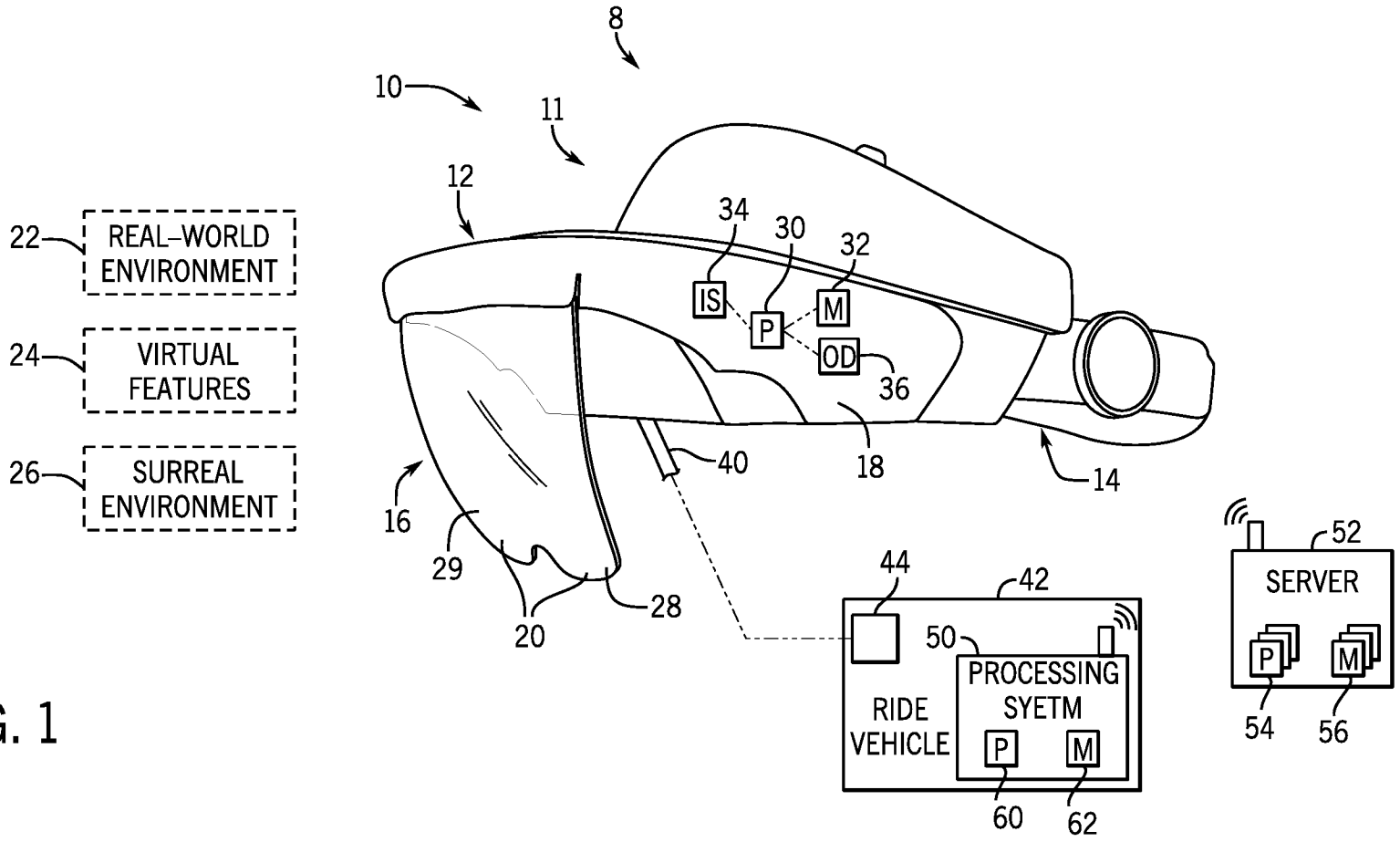
FIG. 1 is a schematic of an augmented reality, virtual reality, and/or mixed reality (AR/VR) system that includes an amusement content processing system, in accordance with present embodiments.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

An amusement park may include an amusement park attraction that is configured to provide the guest with an amusement experience (e.g., a thrill ride; an animated character show; a game; and/or a video, audio, and/or haptic presentation). In certain cases, the amusement park attraction may include an attraction system having an augmented reality (AR), a virtual reality (VR), and/or a mixed reality (combination of AR and VR) system (AR/VR system). The AR/VR system may be configured to enhance a guest experience of the amusement park attraction by providing guests with AR/VR experiences (e.g., AR experiences, VR experiences, or both). Indeed, combinations of certain hardware configurations, software configurations (e.g., algorithmic structures and/or modeled responses), as well as certain attraction features may be utilized to provide guests with AR/VR experiences that may be customizable, personalized, and/or interactive.

For example, the AR/VR system may include an accessory (e.g., a wearable visualization device), such as a head mounted display (e.g., electronic goggles or displays, eyeglasses), which may be worn by a guest during the course of an attraction or while the guest traverses a designated area of the amusement park. The wearable visualization device may be configured to enable the guest to view certain AR/VR scenes. In particular, the wearable visualization device may be utilized to enhance a guest experience by virtually overlaying features in a real-world environment of the amusement park, by providing adjustable virtual environments to provide different experiences in an amusement park ride, and so forth. In some cases, the wearable visualization device may include additional output devices (e.g., audio speakers, haptic devices) configured to provide the guest with feedback (e.g., audio content, haptic feedback) in addition to, or in lieu of, the virtual features presented to the guest via, for example, one or more screens, displays, and/or projectors (e.g., virtual retinal displays) of the wearable visualization device.

In certain cases, the attraction system may include other accessories (e.g., systems or devices) in addition to, or in lieu of, the wearable visualization device, to enhance the guest experience of the amusement park attraction. For example, the attraction system may include one or more projectors (e.g., accessories) that are configured to display (e.g., project onto a surface) content (e.g., video, still images, virtual features) onto certain regions, areas, and/or elements of the amusement park attraction. The content displayed by the projector may be interactive and adjustable based on inputs (e.g., user input) provided by the guest of the attraction. Further, the attraction system may include other accessories (e.g., systems or devices), such as haptic devices, water sprayers, and/or audio sound systems. The wearable visualization device, the projector, and/or the other systems or devices may be used alone or in conjunction with one another to enhance an immersive guest experience provided by the attraction.

As used herein, an "accessory" may refer to any combination of one or more systems, devices, and/or components that are configured to provide amusement content to a guest while the guest is located in or traverses an area of an amusement park, throughout the course of a ride cycle of a ride vehicle occupied by the guest, and/or in another suitable setting. As such, the accessory may include the wearable visualization device, the projector, a haptic device (e.g., a wearable haptic device), an audio sound system (e.g., one or more speakers), a water sprayer, an air nozzle, and so forth. Moreover, "amusement content" may refer to any suitable output that may be provided to the guest via the accessory. As non-limiting examples, the amusement content may refer to AR/VR scenes provided to the guest by the wearable visualization device (e.g., a first accessory), visual images presented to the user via the projector (e.g., a second accessory), haptic output provided to the guest via the haptic device (e.g., a third accessory), audio output provided to the guest via the audio sound system (e.g., a fourth accessory), fluid output (e.g., water, air) provided by the water sprayer or the air nozzle (e.g., a fifth accessory), or any combination thereof.

Embodiments of the present disclosure relate to an amusement content processing system, also referred to herein as a processing system, which is configured to adjust output of amusement content provided to a user (e.g., guest) via an accessory in a manner that facilitates more effective presentation of the amusement content to the user and/or facilitates more seamless integration of the amusement content with other features (e.g., props, animated figures) of an amusement park attraction in which the accessory is implemented. For example, in embodiments where the accessory includes the wearable visualization device or a projector (e.g., a stand alone projector; not configured to be worn by the user), the processing system may be configured to effectuate adjustment of a data stream of amusement content provided to the wearable visualization device or the projector, based on a version or type of the wearable visualization device or the projector implemented in the attraction system, to place the data stream in a format that is more suitable for utilization by the wearable visualization device or the projector and that may enhance overall operation of the wearable visualization device or the projector.

In one embodiment, the processing system may be communicatively coupled to and/or integrated with a server (e.g., a system of one or more computer graphics generation units) that is configured to generate at least a portion of the amusement content to be presented to the user via the accessory (e.g., the wearable visualization device, the projector). The server may be configured to transmit a data stream (e.g., a wireless data stream) that includes the amusement content to the processing system. The processing system may be configured to communicatively couple to the accessory and to transmit some of, all of, or a modified version of the data stream to the accessory for presentation of corresponding amusement content to the user via components (e.g., displays, speakers, haptic devices) of the accessory. Upon establishment of a connection (e.g., a wired or wireless connection) with the accessory, the processing system may identify a version (e.g., type, brand) of the accessory. The processing system may instruct the server to adjust generation of the amusement content or adjust output of the data stream based on the identified version and/or another characteristic of the accessory, such that the particular data stream provided to the accessory is in a format that is most suitable for utilization by the accessory.

As a more specific example, in embodiments where the accessory includes the wearable visualization device, upon connection with the wearable visualization device, the processing system may be configured to determine types, quantities, and/or locations (e.g., with respect to a head of the user and/or coordinate system) of input sensors (e.g., motion sensors, optical sensors, touch sensors) included in the wearable visualization device, to determine types, quantities, and/or locations (e.g., with respect to the head of the user and/or coordinate system) of output devices (e.g., display devices, audio speakers, haptic devices) included in the wearable visualization device, to determine software versions (e.g., driver versions) loaded on the wearable visualization device, amongst other features, as discussed in detail below. The processing system may, based on the identified input sensors, output devices, and/or software versions of the wearable visualization device, instruct the server to adjust output of the amusement content generated by the server and/or instruct the server to generate additional, fewer, or manipulated amusement content to place amusement content in a format that is more effective for presentation to the user by the wearable visualization device and/or to enhance an overall quality (e.g., resolution) of the amusement content transmitted to the wearable visualization device (e.g., by the server). In some cases, the processing system may locally adjust the data stream of amusement content received from the server, based on the identified type or version of the wearable visualization device. Moreover, as discussed below, the processing system may, based on identification of the wearable visualization device, more effectively log, monitor, and/or analyze a health status (e.g., an operational status) of the wearable visualization device throughout operation of the attraction system. Further, the processing system may execute a similar methodology in embodiments where the accessory includes the projector or another type of accessory, for example. These and other features will be described in detail below with reference to the drawings.

With the foregoing in mind, FIG. 1 is a schematic of an embodiment of an attraction system 8 having an AR/VR system 10 configured to enable a user (e.g., a guest, an amusement park employee, a passenger of a ride vehicle) to experience (e.g., view, interact with) AR/VR scenes. In the illustrated embodiment, the AR/VR system 10 includes a wearable visualization system 11 having a wearable visualization device 12 (e.g., an accessory, such as a head mounted display) and a guest interface device 14. The guest interface device 14 (e.g., a head strap assembly) may be configured to couple to a head of the user and to removably couple to the wearable visualization device 12. As such, engagement of the wearable visualization device 12 with the guest interface device 14 may facilitate coupling the wearable visualization device 12 to the head of the user utilizing the AR/VR system 10. In other embodiments, the wearable visualization device 12 may include any other suitable configuration, such as a configuration in which the guest interface device 14 is integral with a housing of the wearable visualization device 12, for example.

In the illustrated embodiment, the wearable visualization device 12 includes a lens portion 16 (e.g., AR/VR eyeglasses, goggles) that is coupled to a housing 18 of the wearable visualization device 12. The lens portion 16 may include one or more lenses 20 or displays (e.g., transparent, semi-transparent, opaque) onto which certain virtual features 24 (e.g., AR features) may be overlaid. In one embodiment, the lenses 20 may enable the user to view a real-world environment 22 (e.g., physical structures in the attraction) through the lenses 20 with certain virtual features 24 overlaid onto the lenses 20 so that the user perceives the virtual features 24 as being integrated into the real-world environment 22. That is, the lens portion 16 may at least partially control a view of the user by overlaying the virtual features 24 onto a line of sight of the user. To this end, the wearable visualization device 12 may enable the user to visualize and perceive a surreal environment 26 (e.g., a game environment) having certain virtual features 24 overlaid onto the physical, real-world environment 22 viewable by the user through the lenses 20. The virtual features 24 may form at least a portion of the amusement content provided to the user via the wearable visualization device 12.

By way of non-limiting example, the lenses 20 may include transparent (e.g., see-through) light emitting diode (LED) displays or transparent (e.g., see-through) organic light emitting diode (OLED) displays. In one embodiment, the lens portion 16 may be formed from a single-piece construction that spans a certain distance so as to display images to both eyes of the user. That is, in such embodiments, the lenses 20 (e.g., a first lens 28, a second lens 29) may be formed from a single, continuous piece of material, where the first lens 28 may be aligned with a first eye (e.g., left eye) of the user and the second lens 29 may be aligned with a second eye (e.g., right eye) of the user. In other embodiments, the lens portion 16 may be a multi-piece construction that is formed from two or more separate lenses 20.

In one embodiment, the wearable visualization device 12 may completely control the view of the user (e.g., using opaque viewing surfaces). That is, the lenses 20 may include opaque or non-transparent displays configured to display virtual features 24 (e.g., VR features) to the user. As such, the surreal environment 26 viewable by the user may be, for example, a real-time video that includes real-world images of the physical, real-world environment 22 electronically merged with one or more virtual features 24. Thus, in wearing the wearable visualization device 12, the user may feel completely encompassed by the surreal environment 26 and may perceive the surreal environment 26 to be the real-world environment 22 that includes certain virtual features 24. In one embodiment, the wearable visualization device 12 may include features, such as light projection features (e.g., virtual retinal displays), configured to project light into one or both eyes of the user so that certain virtual features 24 are superimposed over real-world objects viewable by the user. Such a wearable visualization device 12 may be considered to include a retinal display.

As such, it should be appreciated that the surreal environment 26 may include an AR experience, a VR experience, a mixed reality experience, a computer-mediated reality experience, a combination thereof, or other similar surreal environment. Moreover, it should be understood that the wearable visualization device 12 may be used alone or in combination with other features to create the surreal environment 26. Indeed, as discussed below, the user may wear the wearable visualization device 12 throughout a duration of a ride of an amusement park attraction or during another time, such as during a game, throughout a particular area or attraction of an amusement park, during a ride to a hotel associated with the amusement park, at the hotel, and so forth.

The wearable visualization device 12 may include a local processor 30 and a memory 32 configured to support the creation of aspects of the surreal environment 26, as discussed below. The local processor 30 may be operatively coupled to the memory 32 to execute instructions for carrying out at least a portion of the presently disclosed techniques, for example facilitating display of the virtual features 24 via the lens portion 16. These instructions may be encoded in programs or code stored in a tangible non-transitory computer-readable medium, such as the memory 32 and/or other storage. The local processor 30 may be a general-purpose processor, system-on-chip (SoC) device, an application-specific integrated circuit (ASIC), or some other similar processor configuration.

In one embodiment, the local processor 30 may be communicatively coupled to one or more input sensors 34 of the wearable visualization device 12 that may be configured to provide the local processor 30 with feedback indicative of one or more parameters of an environment surrounding the wearable visualization device 12 and/or of inputs from a user wearing the wearable visualization device 12. For example, the input sensors 34 may include orientation and position sensors (e.g., accelerometers, magnetometers, gyroscopes, Global Positioning System [GPS] receivers), motion tracking sensors (e.g., electromagnetic and solid-state motion tracking sensors), inertial measurement units (IMUs), and/or other sensors that may provide the local processor 30 with feedback indicative of orientation data, position data, point of view data (e.g., focal length, orientation, pose), motion tracking data, and so forth. Additionally or alternatively, the input sensors 34 may include optical sensors configured to provide feedback indicative of ambient lighting surrounding the wearable visualization device 12, touch sensors or buttons configured to transmit a user input to the local processor 30, and others, for example. As discussed below, a quantity, type, and/or location of the input sensors 34 on the wearable visualization device 12 may vary based on the particular type, version, and/or brand of wearable visualization device 12 being utilized in the AR/VR system 10.

In one embodiment, the wearable visualization device 12 includes one or more output devices 36 configured to provide the user with additional amusement content in addition to, or in lieu of, the visual amusement content (e.g., the virtual features 24) presented to the user via the lens portion 16, for example. As a non-limiting example, the output devices 36 may include one or more audio speakers configured to provide the user with audio output (e.g., themed music or noises) and/or haptic devices (e.g., vibration devices) configured to provide the user with haptic feedback. As such, the amusement content provided to the user by the wearable visualization device 12 may include any one or combination of the visual, audio, and/or haptic content that may be output by the wearable visualization device 12 (e.g., via the lens portion 16 and/or the output devices 36). The output devices 36 may be communicatively coupled to the local processor 30 and configured to output corresponding amusement content to the user based on instructions received from the local processor 30. As discussed below, similar to the input sensors 34, a quantity, type, and/or location of the output devices 36 on the wearable visualization device 12 may vary based on the particular type, version, and/or brand of wearable visualization device 12 being utilized in the AR/VR system 10.

In one embodiment, when implemented in an amusement park setting, the wearable visualization device 12 may be physically coupled to (e.g., tethered via a cable 40) a structure (e.g., a ride vehicle 42 of an amusement park ride having the AR/VR system 10) to block separation (e.g., at least temporarily) of the wearable visualization device 12 from the structure. The cable 40 may be removably coupled to the ride vehicle 42 via a connector 44 (e.g., a quick disconnect plug) that enables the user and/or an operator of the amusement park attraction to physically couple or decouple the wearable visualization device 12 to and from the ride vehicle 42. Moreover, the cable 40 may electrically couple the local processor 30 of the wearable visualization device 12 to a processing system 50 (e.g., an amusement content processing system) of the AR/VR system 10 that, in one embodiment, may be included on the ride vehicle 42 (e.g., physically coupled to the ride vehicle 42). As discussed below, in other embodiments, the processing system 50 may not be coupled to the ride vehicle 42 and may be located remote of the ride vehicle 42. Moreover, in one embodiment, the local processor 30 may be communicatively coupled to the processing system 50 via a wireless connection (e.g., a Bluetooth® connection) in lieu of the cable 40. Still further, in one embodiment, the cable 40 may be omitted from the AR/VR system 10, such that the wearable visualization device 12 is not physically tethered to the ride vehicle 42 via the cable 40.

In one embodiment, the processing system 50 may be configured to communicatively couple the local processor 30 to a server 52 (e.g., one or more remote servers, a computer graphics generation unit) that may be located remotely of (e.g., off-board of) the ride vehicle 42. As discussed in detail below, in one embodiment, the local processor 30 may provide the processing system 50 with feedback acquired by, for example, the input sensors 34, and the processing system 50 may provide some of or all of the sensor feedback received from the local processor 30 to the server 52. The server 52 may be configured to utilize at least a portion of the sensor feedback received from the input sensors 34 to generate or otherwise tailor AR/VR content, audio content, and/or haptic content, referred to herein as the "amusement content," for output to the user by the wearable visualization device 12.

For example, the server 52 may generate and transmit amusement content to be displayed or otherwise presented to the user by the wearable visualization device 12. In particular, the server 52 includes one or more remote processors 54 (e.g., general purpose processors or other processors) and a remote memory 56, and may process data useful in generating, for example, the surreal environment 26 for the user. The data useful in generating the surreal environment 26 may include, but is not limited to, real-time data received from the respective input sensors 34 of the wearable visualization device 12, various sensor data acquired by other sensors of the amusement attraction having the AR/VR system 10, and/or data stored in the remote memory 56. In one embodiment, the server 52 may use such data to generate a frame of reference to coordinate the AR/VR features presented by the wearable visualization device 12 in relation to the real-world environment 22 surrounding the user. For example, the server 52 may selectively generate AR/VR graphics to display on the lens portion 16 to reflect changes in the user's orientation, position, gaze direction, field of view, motion, and so forth. The server 52 may also selectively generate the AR/VR graphics to reflect changes in inputs provided by the user of the wearable visualization device 12 (e.g., via one or more of the input sensors 34). Furthermore, the server 52 may generate the AR/VR graphics based on simulated interactions that may cause the AR/VR features to be affected according to certain predetermined or modeled algorithms stored by the server 52 (e.g., in the remote memory 56). As an example, the predetermined or modeled algorithms may be implemented by a physics engine or similar module or as a part of the server 52. In one embodiment, the server 52 may track the information or data set forth above corresponding to multiple users in a shared game, such that a particular user of the multiple users in the shared game may see the game effects applied by other users of the multiple users (e.g., players) in the shared game.

In one embodiment, the server 52 may be communicatively coupled to the local processor 30 of the wearable visualization device 12 in series with the processing system 50. As such, the processing system 50 may receive and transmit information (e.g., a data stream, control signals, sensor feedback) between the local processor 30 and the server 52. The processing system 50 may include an intermediate processor 60 and an intermediate memory 62 configured to execute some of all of the techniques discussed herein. It should be appreciated that, in one embodiment, the processing system 50 may be located off-board of the ride vehicle 42 and, for example, may be integrated with and/or form a portion of the server 52. In such embodiments, the local processor 30 of the wearable visualization device 12 may be communicatively coupled directly to the server 52 (e.g., to the processing system 50 integrated with the server 52). As such, it should be appreciated that the processing system 50, the server 52, or both, may be configured to execute the techniques discussed herein.

Moreover, it should be understood that each of the processors 30, 54, and 60 may include multiple microprocessors, one or more "general-purpose" microprocessors, one or more special-purpose microprocessors, and/or one or more application specific integrated circuits (ASICs), or some combination thereof. For example, the processors 30, 54, and 60 may include one or more reduced instruction set computer (RISC) processors. Each of the memory devices 32, 56, and 62 may include volatile memory, such as random access memory (RAM), and/or nonvolatile memory, such as read-only memory (ROM). The memory devices 32, 56, and 62 may each store information, such as control software, look up tables, configuration data, communication protocols, or the like.

Figure 2:
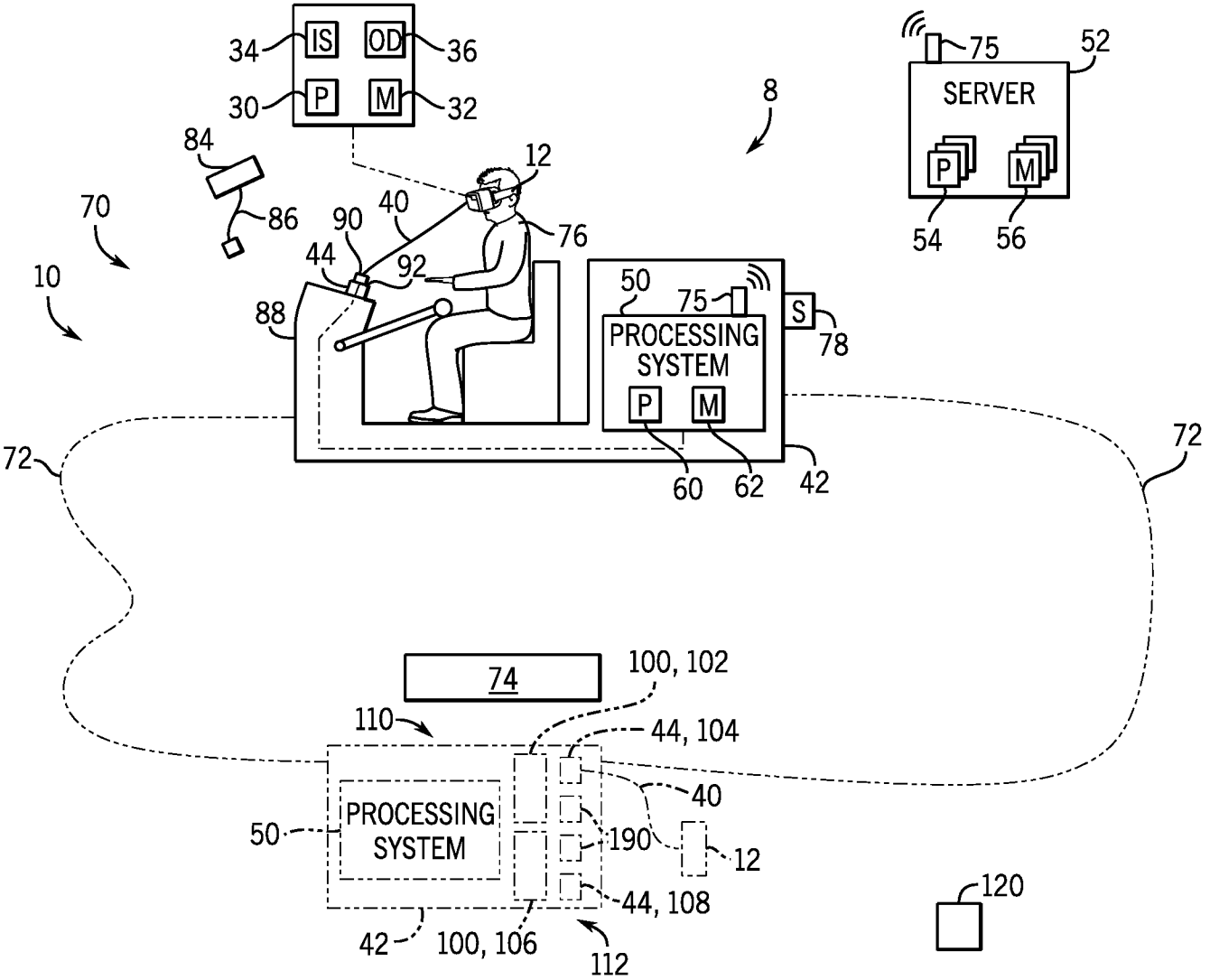
FIG. 2 is a schematic of an amusement park attraction having the amusement content processing system of FIG. 1, in accordance with present embodiments.

FIG. 2 is a schematic of an embodiment of an attraction 70 having the AR/VR system 10. For clarity, it should be understood that the attraction 70 may form some of or all of the attraction system 8. Moreover, the attraction 70 may include any of the accessories discussed in further detail herein. The attraction 70 may include a path 72 (e.g., a predefined or undefined track) along which the ride vehicle 42 is configured to travel during sequential ride cycles (e.g., loading/unloading cycles) of the attraction 70. For example, the ride vehicle 42 may be configured to iteratively execute ride cycles along the path 72 while periodically allowing loading of passengers (e.g., users of the AR/VR system 10) into or unloading of passengers out of the ride vehicle 42 at a loading/unloading platform 74 of the attraction 70. As discussed above, in one embodiment, the processing system 50 may be included in (e.g., coupled to) the ride vehicle 42 and configured to travel with the ride vehicle 42 along the path 72. The processing system 50 may be communicatively coupled to the server 52 via suitable communication circuitry 75 (e.g., wireless communication components).

As discussed above, the server 52 may be configured to render and generate the amusement content to be presented (e.g., via the wearable visualization device 12) to a user 76 of the attraction 70 (e.g., such as while the ride vehicle 42 executes the ride cycle). The server 52 may be configured to synchronize presentation of the amusement content based on a position of the ride vehicle 42 along the path 72, based on features (e.g., animated figures) disposed about the path 72, and/or based on game play or other inputs from the user 76. The server 52 may be configured to determine the position of the ride vehicle 42 along the path based on sensor feedback received from the input sensors 34 of the wearable visualization device 12, one or more sensors 78 (e.g., tracking sensors) included on the ride vehicle 42, or from other data received from a central ride control system of the attraction 70. In any case, the server 52 may transmit (e.g., via the communication circuitry 75) a data stream including control instructions for output the amusement content to the processing system 50, which may transmit some of, all of, or a modified version of the control instructions (e.g., the data stream) to the wearable visualization device 12 to enable presentation of the amusement content to the user 76. The data stream may include a variety of control instructions that enable the wearable visualization device 12 to output presentation of the amusement content (e.g., visual content, audio content, haptic content) to the user 76. As discussed below, the processing system 50 may adjust or modify the control instructions in the data stream received from the server 52, or may instruct the server 52 to generate and provide a modified data stream having alternate control instructions, based on the identified type of wearable visualization device 12 communicatively coupled to the processing system 50. As used herein, "control instructions" may include instructions for operating and/or controlling one or more designated components, features, and/or subsystems of an accessory (e.g., the wearable visualization device 12), for example.

Figure 3:
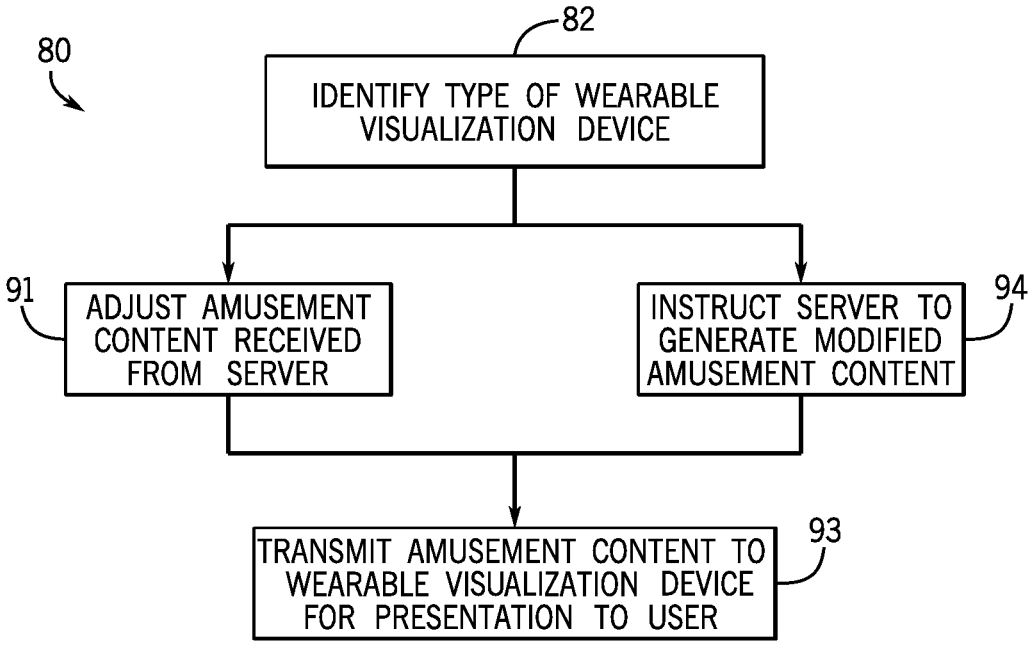
FIG. 3 is a flow diagram of an embodiment of a process for operating the amusement content processing system of FIG. 1, in accordance with present embodiments.

To facilitate the following discussion, FIG. 3 is a flow diagram of an embodiment of a process 80 for adjusting amusement content provided to the wearable visualization device 12 for presentation to the user based on the type of wearable visualization device 12 coupled (e.g., wirelessly coupled, electrically coupled) to the processing system 50. The process 80 may be useful in creating a customized AR experience, VR experience, and/or mixed reality experience during the course of the ride cycle of the attraction 70, for example. The process 80 may be representative of initiated code or instructions stored in a non-transitory computer-readable medium (e.g., the memory 32, 56, and/or 62) and executed by, for example, the intermediate processor 60 of the processing system 50. For clarity, the following discussion may continue with concurrent reference to FIGS. 2 and 3.

The process 80 may begin with identifying a type of wearable visualization device 12 communicatively coupled to the processing system 50, as indicated by block 82. For example, in one embodiment, an alternate wearable visualization device 84 may initially be physically and electrically coupled to the ride vehicle 42 via a corresponding cable 86. In one embodiment, a user (e.g., an operator of the attraction 70, the user 76) may decouple the alternate wearable visualization device 84 from the ride vehicle 42 by detaching the corresponding cable 86 from the connector 44, which may be coupled to a support structure 88 (e.g., a chassis) of the ride vehicle 42. The user may replace the alternate wearable visualization device 84 with the wearable visualization device 12 by, for example, coupling the cable 40 of the wearable visualization device 12 to the connector 44 to physically and/or electrically couple the wearable visualization device 12 to the ride vehicle 42.

Upon receiving feedback that a new wearable visualization device (e.g., the wearable visualization device 12) has been coupled to the ride vehicle 42, the processing system 50 may identify the type or version of the wearable visualization device 12 (e.g., at the block 82). For example, the processing system 50 may identify the type of wearable visualization device 12 via communication with the local processor 30, which may be configured to transmit information relating to a version, brand, and/or serial number of the wearable visualization device 12 to the processing system 50.

In one embodiment, the processing system 50 may identify the type of wearable visualization device 12 based on a structure or version of a plug 90 of the cable 40 that may be used to couple the cable 40 to the connector 44. For example, the connector 44 may include a variety of receiving ports 92 configured to receive a variety of different plugs 90. Each of the plugs 90 may be associated with or known to correspond to a different type of wearable visualization device 12. The processing system 50 may identify the type of wearable visualization device 12 coupled to the ride vehicle 42 based on the particular type of receiving port 92 that is engaged via a corresponding plug 90 (e.g., a High-Definition Multimedia Interface [HDMI] plug, a Universal Serial Bus [USB] plug, etc.). That is, the processing system 50 may identify the wearable visualization device 12 as a first type of wearable visualization device 12 in response to a determination that the plug 90 is engaged with a first receiving port included in the receiving ports 92, and may identify the wearable visualization device 12 as a second type of wearable visualization device 12 in response to a determination that the plug 90 is engaged with a second receiving port included in the receiving ports 92. In other embodiments, the processing system 50 may determine the type of wearable visualization device 12 via transmission of one more test signals to the wearable visualization device 12, as discussed below.

As part of execution of the block 82, the processing system 50 may determine operational characteristics associated with the type of wearable visualization device 12 coupled to the ride vehicle 42. Such operational characteristics may include types, quantities, and/or relative locations of the input sensors 34 included in the wearable visualization device 12, types, quantities, and/or relative locations of the output devices 36 (e.g., display devices, audio speakers, haptic devices) included in the wearable visualization device 12, software versions (e.g., drivers) loaded on the local processor 30 of the wearable visualization device 12, a refresh rate (e.g., 60 Hertz [Hz], 90 Hz) of displays included on the wearable visualization device 12, amongst other features. For example, in one embodiment, upon receiving a request from the processing system 50, the local processor 30 may provide the processing system 50 with feedback (e.g., digital and/or analog data) indicative of the operational characteristics of the wearable visualization device 12. The processing system 50 may also access a database that stores the operational characteristics of various types and/or versions of wearable visualization devices, and the processing system 50 may search the database by the type and/or version of the wearable visualization device 12 to determine the operational characteristics of the wearable visualization device 12.

Additionally or alternatively, the processing system 50 may send test signals to the wearable visualization device 12 to identify, for example, the type of input sensors 34 and/or the type of output devices 36 included on the wearable visualization device 12. As a non-limiting example, the processing system 50 may send a test signal to determine whether the output devices 36 include a haptic output device. If the wearable visualization device 12 includes a haptic output device, such that the processing system 50 receives feedback from the haptic output device in response to the test signal, the processing system 50 may log and store (e.g., in the memory 62) an indication that the particular wearable visualization device 12 currently coupled to the processing system 50 includes the haptic output device. Alternatively, if no response from a haptic output device is received in response to transmission of the test signal from the processing system 50 to the wearable visualization device 12, the processing system 50 may log and store (e.g., in the memory 62) an indication that the wearable visualization device 12 does not include the haptic output device. The test(s) may be automated in this way or may include a manual component (e.g., guest input). For example, after the test signal(s), the user 76 may be prompted (e.g., via text presented on the lenses 20) to provide spoken and/or keyed inputs to indicate whether the wearable visualization device 12 provided the corresponding output(s).

It should be appreciated that the processing system 50 may, upon receiving an indication that a particular wearable visualization device 12 has been coupled to the connector 44 or wirelessly coupled to the processing system 50, execute the aforementioned techniques to determine a wide variety of operational characteristics of the wearable visualization device 12 in addition to, or in lieu of, the exemplary operational characteristics discussed above. Moreover, it should be understood that, in embodiments where the wearable visualization device 12 is wirelessly coupled to the processing system 50 (e.g., in lieu of the cable 40), the processing system 50 may execute the block 82 upon a determination that a wireless communication signal has been established between the wearable visualization device 12 and the processing system 50. For example, the processing system 50 may execute the block 82 upon a determination that a first wireless communication signal between a first wearable visualization device (e.g., the alternate wearable visualization device 84) and the processing system 50 has be severed, and a second wireless communication signal between a second wearable visualization device (e.g., the wearable visualization device 12) and the processing system 50 has been established.

In one embodiment, different wearable visualization devices (e.g., the wearable visualization devices 12 or 84) may be communicatively coupled (e.g., wired or wirelessly) to the processing system 50 during each iteration of the ride cycle of the attraction 70. For example, in one embodiment, guests of the attraction 70 may bring their own, dedicated wearable visualization device 12 (e.g., a wearable visualization device personally owned, borrowed, and/or rented by the guest) to the attraction 70 and establish communication between the processing system 50 and their dedicated wearable visualization device 12 during a loading cycle of the attraction 70, prior to execution of the ride cycle of the ride vehicle 42. As such, the guest may wear the dedicated wearable visualization device 12 throughout the course of the ride cycle and may decouple (e.g., physically decouple, communicatively decouple) the wearable visualization device 12 from the ride vehicle 42 at the conclusion of the ride cycle, such as when the ride vehicle 42 re-enters the loading/unloading platform 74 for unloading the guest from the ride vehicle 42. As such, the processing system 50 may execute block 82 of the process 80 during each iteration of the ride cycle. In other embodiments, the wearable visualization device 12 may remain coupled (e.g., physically coupled, communicatively coupled) to the ride vehicle 42 for multiple ride cycles (e.g., tens, hundreds, or thousands of ride cycles) and may instead be decoupled (e.g., physically decoupled, communicatively decoupled) from the ride vehicle 42 upon execution of a predetermined number of ride cycles and replaced with another wearable visualization device (e.g., to enable maintenance or inspection of the decoupled wearable visualization device).

In one embodiment, upon identification of the type of wearable visualization device 12 currently coupled (e.g., communicatively coupled) to the processing system 50 at the block 82, the processing system 50 may adjust (e.g., modify) the amusement content received from the server 52 (e.g., during the ride cycle of the attraction 70) based on the identified type of the wearable visualization device 12 and prior to transmission of the amusement content to the wearable visualization device 12, as indicated by block 91. For example, during a course of the ride cycle of the attraction 70, the server 52 may generate and output a first data stream to the processing system 50 that includes control instructions (e.g., first transmission parameters) useful for presenting amusement content to the user 76 via the wearable visualization device 12. Based on information relating to the identified type of the wearable visualization device 12 (e.g., as determined at block 82), the processing system 50 may modify one or more of the control instructions in the first data stream received from the server 52 to generate a second data stream (e.g., a modified data stream having second transmission parameters), and may subsequently transmit the second data stream to the wearable visualization device 12, as indicated by block 93. To this end, the processing system 50 may convert the first data stream to a format (e.g., the format of the second data stream) that, when received by the wearable visualization device 12, enables the wearable visualization device 12 to more suitably output the amusement content to the user 76 (e.g., as compared to when the wearable visualization device 12 receives the first data stream from the server 52).

For example, in one embodiment, the server 52 may output a data stream of amusement content that includes virtual features presented at a first resolution and/or a first refresh rate (e.g., 90 Hz). That is, the server 52 may output a data stream of amusement content having a first set of transmission parameters. The processing system 50 may determine (e.g., at block 82) that the wearable visualization device 12 includes a display system configured to operate at a second resolution and/or a second refresh rate (e.g., 60 Hz), which may be different than the first resolution and/or the first refresh rate of the data stream provided by the server 52. In such embodiments, the processing system 50 may adjust or modify (e.g., locally on the local processor 30) the data stream received by the server 52 and output a modified data stream having virtual features presented at the second resolution and/or the second refresh rate to the wearable visualization device 12. That is, the server 52 may output a data stream of amusement content having a second (e.g., different) set of transmission parameters. To this end, the processing system 50 may modify the data stream received from the server 52 to have a format that is more suitable for usage by the components of the wearable visualization device 12 (e.g., the display system of the wearable visualization device 12), prior to transmission of the data stream to the wearable visualization device 12 (e.g., to the local processor 30 of the wearable visualization device 12).

As another example, the processing system 50 may determine, at the block 82, that the wearable visualization device 12 includes, for example, output devices 36 (e.g., speakers) configured to output a particular format of audio stream (e.g., mono, stereo) that may be different than the format of audio stream output by the server 52. In such embodiments, the processing system 50 may receive the audio stream from the server 52, convert the audio stream received from the server 52 to the preferred audio format to be received by the wearable visualization device 12, and transmit a modified audio stream to the wearable visualization device 12 having the preferred format of the wearable visualization device 12. As such, it should be understood that the processing system 50 may, based on the determined operational characteristics of the wearable visualization device 12, adjust multiple parameters (e.g., control instructions) of the amusement content data stream received from the server 52 prior to transmission of the amusement content data stream to the local processor 30 of the wearable visualization device 12.

Additionally or alternatively to execution of the block 91, the processing system 50 may, upon execution of the block 82, instruct the server 52 to generate a modified data stream that includes adjusted amusement content, where the adjustment amusement contentment is determined based on the identified type of wearable visualization device 12 currently coupled to the processing system 50, as indicated by block 94. That is, the processing system 50 may instruct the server 52 to adjust or modify generation of at least one aspect of the data stream of amusement content generated by the server 52 prior to transmission of the data stream from the server 52 to the processing system 50. In other words, the processing system 50 may instruct the server 52 to remotely adjust generation and/or modify generation of at least an aspect of the amusement content based on the identified type of the wearable visualization device 12, instead of adjusting the aspect locally via, for example, the intermediate processor 60 of the processing system 50.

For example, upon determining the particular operational characteristics (e.g., display resolution and/or refresh rate) of the wearable visualization device 12 at the block 82, the processing system 50 may instruct the server 52 to output a data stream of amusement content in a format (e.g., display resolution, refresh rate) that corresponds to the particular operational characteristics of the wearable visualization device 12. In one embodiment, based on the determined operational characteristics of the wearable visualization device 12, the processing system 50 may instruct the server 52 to include additional data or fewer data in the data stream of amusement content output by the server 52. In this manner, the processing system 50 may facilitate efficient transmission of data (e.g., via the communication circuitry 75) suitable for effective operation of the wearable visualization device 12 while omitting or reducing transmission of data which may not be usable or not effectively useable by the particular components included in the wearable visualization device 12, for example. This may reduce latency in the presentation of amusement content to the user 76 via the wearable visualization device 12.

For example, in one embodiment, the server 52 may default to including, in the data stream of amusement content, control instructions for operating a first group of output devices 36. During execution of the block 82, the processing system 50 may determine that the particular wearable visualization device 12 currently coupled to the processing system 50 does not include certain of the output devices 36 for which instructional data is typically (e.g., default content) provided by the server 52. In such embodiments, the processing system 50 may instruct the server 52 to stay output of data relating to the output devices 36 that are identified as being omitted from the particular wearable visualization device 12, such that the processing system 50 may reduce or eliminate transmission of superfluous data from the server 52 to the processing system 50. As an example, as part of the amusement content data stream, the server 52 may typically output control instructions used to control operation of a haptic feedback device that may be included in the wearable visualization device 12. If, at the block 82, the processing system 50 determines that the wearable visualization device 12 does not include a haptic device as part of the output devices 36, the processing system 50 may instruct the server 52 to temporarily stay generation and/or transmission of control instructions for the haptic feedback device.

Conversely, in one embodiment, the wearable visualization device 12 may include additional output devices 36 for which the server 52 typically does not provide control instructions. Upon a determination (e.g., at the block 82) that the wearable visualization device 12 includes such output devices 36, the processing system 50 may instruct the server 52 to generate additional control instructions corresponding to the additional output devices 36 and to include such control instructions in the data stream of amusement content broadcasted to the processing system 50. It should be understood that, in one embodiment, the blocks 91 and 94 of the process 80 may be executed in unison. That is, in such embodiments, the processing system 50 may adjust at least a portion of the control instructions received from the server 52 and included in the amusement content data stream locally (e.g., via the intermediate processor 60), while instructing the server 52 to adjust or modify at least a portion of the control instructions prior to transmission of the data stream from the server 52 to the processing system 50. In this way, the processing system 50 may operate in a manner that results in appropriate, customized control instructions for a first wearable visualization device (e.g., a first type), a second wearable visualization device (e.g., a second type), and so on. In one embodiment, the processing system 50 may operate in a manner that results in the default content being provided while the corresponding wearable visualization device (which may be a most common type and/or a type provided by the amusement park) is connected and/or while the type or other features of the wearable visualization device that is connected cannot be determined (e.g., unrecognized and/or unknown).

In one embodiment, the processing system 50 may instruct the server 52 to utilize different types of modeling algorithms (e.g., graphics generation algorithms for generating the amusement content) based on identified type of the wearable visualization device 12. For example, in one embodiment, a first identified type of the wearable visualization device 12 may include a first group of input sensors 34 configured to sample data at a relatively high acquisition frequency, to sample data at a relatively high resolution, and/or to sample a relatively high quantity of different operating parameters (e.g., acceleration, velocity, altitude, light, guest audio input). In such embodiments, the processing system 50 may instruct the server 52 to use a first modeling algorithm (e.g., an advanced modeling algorithm) to generate the data stream of the amusement content, where the first modeling algorithm may be suitable to effectively intake and analyze the feedback received from the first group of input sensors 34 included in the first type of wearable visualization device 12. As such, the processing system 50 may instruct the server 52 to generate amusement content at a relatively high resolution and granularity, for example. In other embodiments, a second identified type of the wearable visualization device 12 may include a second group of input sensors 34 configured to sample data at a relatively low acquisition frequency, to sample data at a relatively low resolution, and/or to sample a relatively low quantity of different operating parameters (e.g., acceleration and velocity only). In such embodiments, the processing system 50 may instruct the server 52 to use a second modeling algorithm (e.g., a basic modeling algorithm) to generate the data stream of the amusement content, where the second modeling algorithm may be suitable to effectively intake and analyze the feedback received from the second group of input sensors 34 included in the second type of wearable visualization device 12. Accordingly, the processing system 50 may instruct the server 52 to generate amusement content at a relatively low resolution or granularity. In this manner, the processing system 50 may operate the server 52 to provide a data stream of amusement content that is tailored to enable effective operation of various different wearable visualization devices 12 that may be coupled to the ride vehicle 42 while reducing congestion on the communication network provided by the communication circuitry 75, for example.

In one embodiment, the processing system 50 may instruct the server 52 to adjust the type of modeling algorithm used to generate the data stream of the amusement content based on a detected version of software and/or drivers loaded onto, for example, the memory 32 of the wearable visualization device 12. In one embodiment, the local processor 30 of the wearable visualization device 12 may, upon communicative coupling of the wearable visualization device 12 to the processing system 50, upload drivers, programs, or other data to the server 52 for usage by the server 52 during generation of the amusement content. As an example, the local processor 30 may upload drivers and/or control algorithms to the server 52 that may enable the server 52 to generate additional amusement content and/or adjusted amusement content for output by the wearable visualization device 12. The processing system 50 may operate in a manner that results in default modeling algorithms being used while the corresponding wearable visualization device is connected and/or while the type or other features of the wearable visualization device that is connected cannot be determined (e.g., unrecognized and/or unknown).

In one embodiment, the processing system 50 may facilitate monitoring and logging of a health status (e.g., an operational status or functionality) or life cycle of the wearable visualization device 12. For example, upon coupling of the wearable visualization device 12 to the ride vehicle 42 (e.g., to the connector 44), the processing system 50 may determine a location of the wearable visualization device 12 in the ride vehicle 42. For example, each seat 100 of the ride vehicle 42 may be associated with a particular connector 44. That is, a first seat 102 of the ride vehicle 42 may include a first connector 104 configured to receive the wearable visualization device 12 and a second seat 106 of the ride vehicle 42 may include a second connector 108 configured to receive the wearable visualization device 12. As such, the processing system 50 may determine whether the wearable visualization device 12 is used by a passenger located in the first seat 102 or the second seat 106 based on the identified connector 104 or 106 to which the wearable visualization device 12 is coupled. In other embodiments, such as where the wearable visualization device 12 is wirelessly coupled to the processing system 50, the processing system 50 may determine whether the wearable visualization device 12 is used by a passenger in the first seat 102 or a passenger in the second seat 106 based on other sensor feedback (e.g., feedback from proximity sensors included on the ride vehicle 42 and/or tracking sensors included in the wearable visualization device 12).

As shown in the illustrated embodiment of FIG. 2, the first seat 102 may be located near an entry/exit side 110 of the ride vehicle 42 that is positioned adjacent to the loading/unloading platform 74 during loading/unloading operations of the ride vehicle 42, whereas the second seat 106 may be located near an opposing side 112 of the ride vehicle 42 that is distal to the loading/unloading platform 74 during loading/unloading operations of the ride vehicle 42. As such, passengers boarding/unloading from the both first seat 102 and the second seat 106 may pass the wearable visualization device 12 associated with the first seat 102 during each loading/unloading cycle of the ride vehicle 42, such that more passengers may pass a wearable visualization device 12 associated with the first seat 102 over an operating period of the attraction 70 than may pass another wearable visualization device associated with the second seat 106. The processing system 50 may log a quantity of ride cycles that each of the wearable visualization devices included in the attraction 70 are coupled to connectors 44 associated with particular seats 102 or 106, as well as receive feedback that indicates that certain components of the wearable visualization devices are not functioning properly (e.g., no haptic response, no audio, and/or missing pixels). As such, the processing system 50 may facilitate acquisition of data that may be used (e.g., by an operator of the attraction 70) to determine whether a location of the wearable visualization device 12 on the ride vehicle 42 (e.g., near the first seat 102, near the second seat 106) affects an operational life or health of the wearable visualization device 12.

In one embodiment, the processing system 50 may generate instructions to adjust a position of the wearable visualization device 12 on the ride vehicle 42 upon a determination that a differential between the amount of ride cycles for which the wearable visualization device 12 was implemented on the first seat 102 (e.g., coupled to the first connector 104) and the amount of ride cycles for which the wearable visualization device 12 was implemented on the second seat 106 (e.g., coupled to the second connector 108) exceeds a threshold. The instructions may include transmission of a message to an electronic device 120 carried by an operator of the attraction 70, illumination of a light emitter (e.g., on the wearable visualization device 12), an audible alert, or another suitable alert (to prompt moving the wearable visualization device 12 from the first seat 102 to the second seat 106). As such, the processing system 50 may facilitate balanced usage of the wearable visualization device 12 between the first and seconds seats 102, 106 (e.g., less than a threshold differential), which may enhance an operational life of the wearable visualization device 12.

It should be appreciated that other accessories 190 may be coupled to the ride vehicle 42 in addition to, or in lieu of, the wearable visualization devices 12. As discussed in detail herein, such accessories 190 may include, for example, projectors configured to project light onto a suitable surface of the ride vehicle 42 and/or onto or toward another suitable object or region of the attraction system 8. Additionally, or alternatively, the accessories 190 may include haptic devices that may be coupled to the first and second seats 102, 106, for example, and configured to vibrate the seats 102, 106 in response to user input and/or while the ride vehicle 42 traverses a predetermined section of the path 72. In such an embodiment, the processing system 50 may monitor a health of these accessories 190 in accordance with the techniques discussed herein. In this way, the processing system 50 may similarly facilitate balanced usage of the accessories 190 between the first and seconds seats 102, 106 and, thus, may enhance an operational life of the accessories 190.

Figure 4:
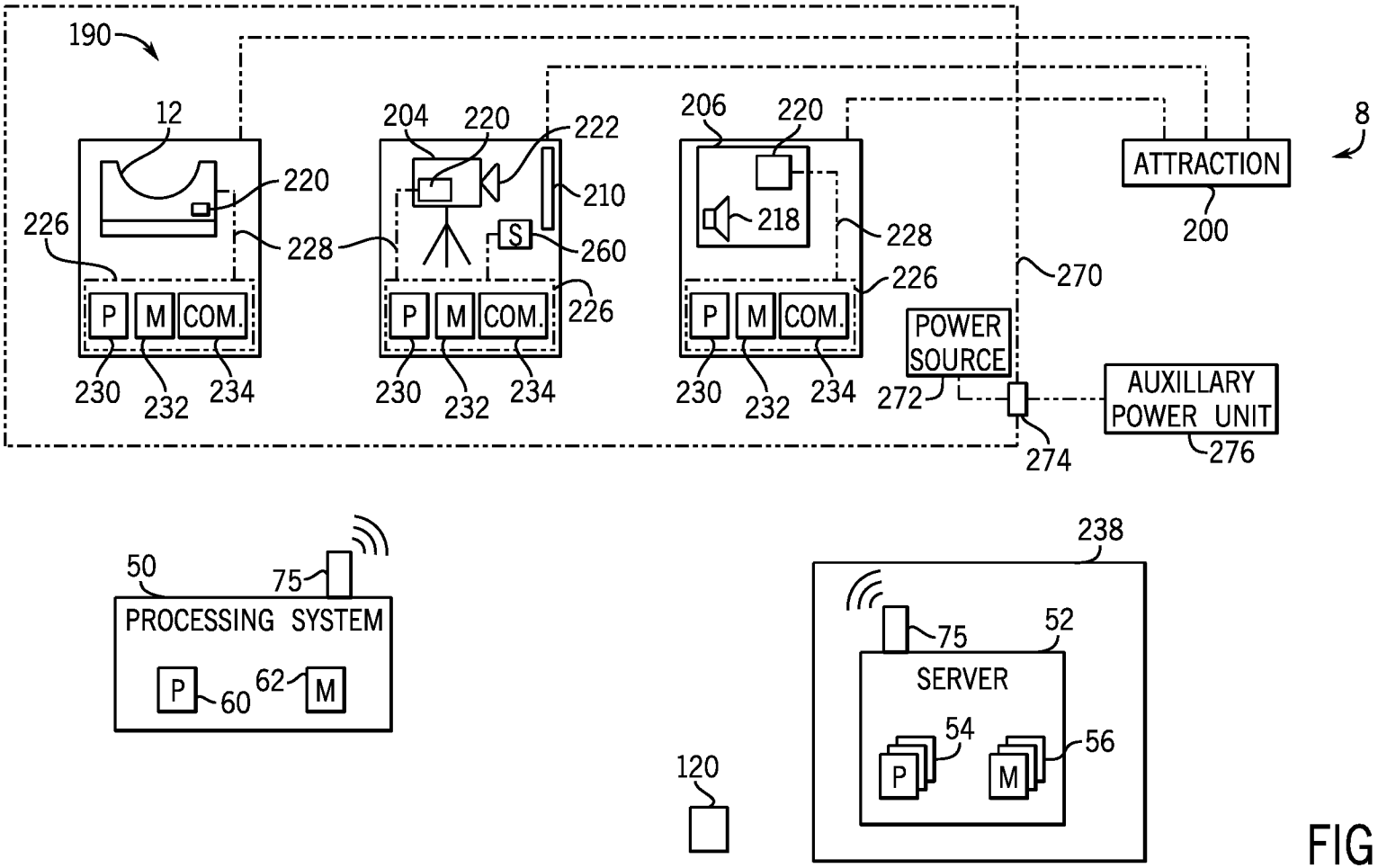
FIG. 4 is a schematic of an amusement park attraction having an amusement content processing system, in accordance with present embodiments.

FIG. 4 is a schematic of an embodiment of an attraction 200 that may form at least a portion of the attraction system 8. It should be understood that the attraction 200 may include some of or all of the features of the attraction 70. In the illustrated embodiment, the attraction 200 includes one or more accessories 190 that may be configured to output amusement content to the user 76 (e.g., during the course of a ride cycle of the attraction system 8). For example, the accessories 190 may include the wearable visualization device 12 (or multiple wearable visualization devices 12), a projector 204 (or multiple projectors), an auxiliary accessory 206, or a combination thereof. The projector 204 may include a stand-alone projection device (e.g., a light projection device; physically separate from the wearable visualization device 12 and/or not configured to be worn by the user 76) that is configured to project still images, video, augmented reality content, or a combination thereof, onto a surface of an object 210 or element of the attraction 200. For example, in one embodiment, the projector 204 may be coupled to the ride vehicle 42 and the object 210 may include a region on or within the ride vehicle 42 onto which the projector 204 is configured to project the amusement content.

In another embodiment, the object 210 may include a suitable surface of a theatre, a portion of an animated figure, and so forth. Indeed, it should be appreciated that the projector 204 may not be coupled to the ride vehicle 42 and, instead, may be located (e.g., stationary) in another suitable area of an amusement park environment. The auxiliary accessory 206 may include one or more haptic devices configured to provide haptic feedback to the user 76. For example, the auxiliary accessory 206 may be coupled to the seat 100 of the ride vehicle 42 and configured to provide vibrational input to the seat 100. Additionally or alternatively, the auxiliary accessory 206 may include a wearable haptic device that is configured to be worn by the user 76 to provide haptic feedback directly to the user 76. Further, the auxiliary accessory 206 may include an audio system having one or more speakers 218 configured to output audio content, a fluid spray system having one or more nozzles configured to direct a fluid flow (e.g., water, air) along a region of the attraction 200 and/or toward or onto the user 76, another suitable accessory configured to interact with the user 76, or a combination thereof.

In one embodiment, each of the accessories 190 may include integrated control circuitry 220 that is configured to control operation of some of or all of the components of the corresponding accessories 190. For example, the integrated control circuitry 220 (e.g., the local processor 30, the memory 32) of the wearable visualization device 12 may be configured to drive operation of display components configured to project AR/VR content onto the lens portion 16 of the wearable visualization device 12. The integrated control circuitry 220 of the projector 204 may be configured to drive operation of display components (e.g., one or more lenses 222) configured to project visual features onto the object 210. Further, the integrated control circuitry 220 of the auxiliary accessory 206 may drive operation of corresponding components (e.g., the speakers 218, haptic devices) of the auxiliary accessory 206.

In one embodiment, the integrated control circuitry 220 may lack the functionality to enable communication (e.g., wireless communication) with the processing system 50. As discussed in detail herein, the integrated control circuitry 220 of each of the accessories 190 may therefore be communicatively coupled to a corresponding control board 226, which may be configured to enable communication between the corresponding accessories 190 and the processing system 50. The control boards 226 may be electrically and/or communicatively coupled to the corresponding integrated control circuitry 220 via a wired connection 228 or via a suitable wireless connection that may be established between the integrated control circuitry 220 and the control board 226. As such, the control board 226 may be retrofitted to a suitable accessory 190 to enable the accessory 190 to communicate with, send data to, and/or be controlled by the processing system 50 and/or the server 52 in accordance with the presently disclosed techniques. That is, the control boards 226 may operate as intermediate communication components that facilitate communication between the integrated control circuitries 220 of the accessories 190 and the processing system 50 and/or the server 52, for example.

As an example, in one embodiment, each of the control boards 226 may include an enclosure configured to house a corresponding processor 230 and a corresponding memory 232. The processors 230 may include multiple microprocessors, one or more "general-purpose" microprocessors, one or more special-purpose microprocessors, and/or one or more application specific integrated circuits (ASICs), or some combination thereof. For example, the processors 230 may include one or more reduced instruction set computer (RISC) processors. Each of the memory devices 232 may include volatile memory, such as random access memory (RAM), and/or nonvolatile memory, such as read-only memory (ROM). The memory devices 232 may each store information, such as control software, look up tables, configuration data, communication protocols, or the like. Moreover, each of the control boards 226 may each include a communication component 234 that facilitates wireless communication between the integrated control circuitries 220 of the accessories 190 and the processing system 50, and/or between the integrated control circuitries 220 of the accessories 190 and the server 52. That is, the communication components 234 may facilitate communication with the processing system 50 and/or the server 52 via the communication circuitry 75.

As such, a user (e.g., an operator of the attraction system 8) may utilize the control boards 226 to enhance an operational functionality of the accessories 190. That is, the user may couple (e.g., electrically couple, communicatively couple, physically couple) the control board 226 to a corresponding accessory 190 to enable control and operation of the accessory 190 in accordance with the presently disclosed techniques. In one embodiment, the control board 226 may be disposed within a housing of the corresponding accessory 190 and/or may be integrated with the integrated control circuitry 220 of the accessory 190. In any case, the control boards 226 may enable wireless communication (e.g., via fourth generation [4G] broadband cellular network technology, via fifth generation [5G] broadband cellular network technology) between the corresponding accessories 190 and the processing system 50 and/or server 52. In another embodiment, the integrated control circuitry 220 may have the functionality to communicate (e.g., wirelessly communicate) with the processing system 50, such that the control board 226 may be omitted from the corresponding accessory 190.

The server 52 may be configured to generate control instructions that, when transmitted to the accessories 190 (e.g., via communication between the processing system 50 and the corresponding control boards 226), enable the accessories 190 to output particular amusement content to the user 76 of the attraction 200 (e.g., such as during a ride cycle of the attraction 200). As discussed below, the control instructions may include control instruction suitable for effectuating output of a variety of different amusement content via operation of the accessories 190. The server 52 may be configured to synchronize presentation of the amusement content based on a position of a ride vehicle (e.g., the ride vehicle 42) along a path or in an area (e.g., operating area) of the attraction 200, based on features (e.g., animated figures) disposed about the path of the attraction 200, and/or based on game play or other inputs from the user 76. In any case, the server 52 may transmit (e.g., via the communication circuitry 75) a data stream including control instructions for output the amusement content to the processing system 50, which may transmit some of, all of, or a modified version of the control instructions (e.g., the data stream) to any one or combination of the accessories 190 (e.g., via communication with the control boards 226) to enable presentation of the amusement content to the user 76. As discussed below, the processing system 50 may adjust or modify the control instructions in the data stream received from the server 52, or may instruct the server 52 to generate and provide a modified data stream having alternate control instructions, based on the identified types or versions of the accessories 190 communicatively coupled to the processing system 50. It should be appreciated that, in one embodiment, the processing system 50 may be integrated with the server 52. For example, in such an embodiment, the server 52 may perform the functions of the processing system 50 discussed herein. As such, the processing system 50 and the server 52 may, for example, be housed in a common enclosure 238 that is remote from the accessories 190.

Figure 5:
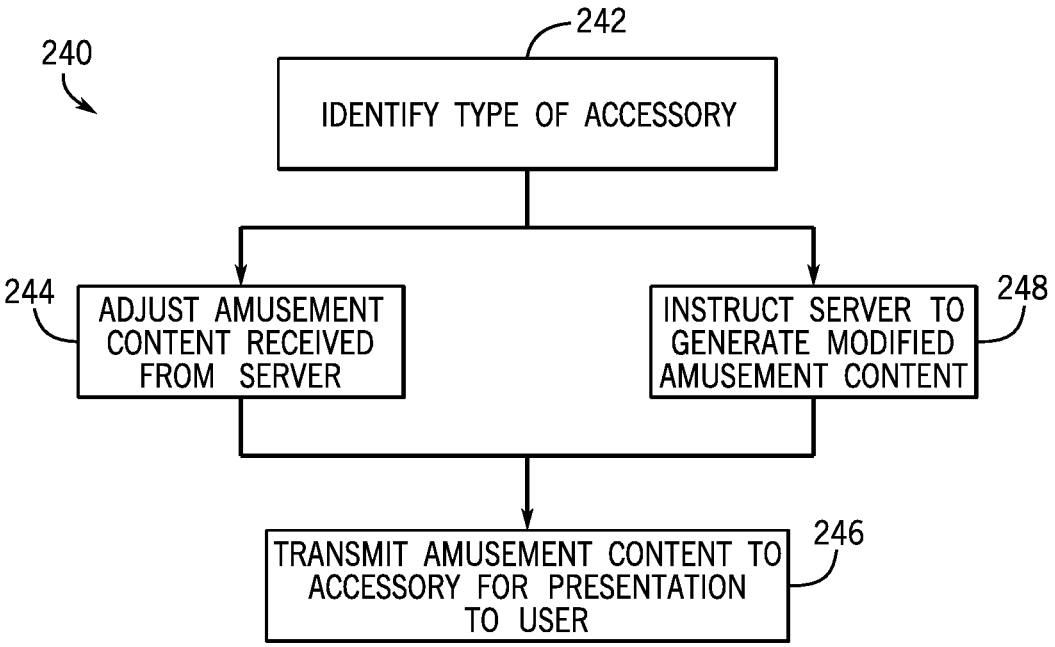
FIG. 5 is a flow diagram of an embodiment of a process for operating the amusement content processing system of FIG. 4, in accordance with present embodiments.

To facilitate the following discussion, FIG. 5 is a flow diagram of an embodiment of a process 240 for adjusting amusement content provided to the accessories 190 for presentation to the user based on a type, version, and/or characteristic of the accessory 190 coupled (e.g., wirelessly coupled) to the processing system 50. The process 240 may be useful in creating a customized amusement content to be provided to the user 76 during the course of the ride cycle of the attraction 200, for example. Moreover, the process 240 may facilitate automatically adjusting or modifying amusement content generated by the server 52 in response to a determination that a different accessory 190 has been communicatively coupled the processing system 50. As such, the process 240 may facilitate adjustment of amusement content in response to replacement of one or more of the accessories 190 during maintenance that may be performed on the attraction 200, for example. The process 240 may be representative of initiated code or instructions stored in a non-transitory computer-readable medium (e.g., the memory 32, 56, 62, and/or 230) and executed by, for example, the intermediate processor 60 of the processing system 50. For clarity, the following discussion may continue with concurrent reference to FIGS. 4 and 5.

The process 240 may begin with identifying a type of accessory 190 communicatively coupled to the processing system 50, as indicated by block 242. For example, in one embodiment, a user (e.g., an operator of the attraction 200, the user 76) may communicatively couple (e.g., via the communication circuitry 75 and the corresponding communication component 234) the projector 204 to the processing system 50 to establish a wireless communication channel between the projector 204 and the processing system 50. The user may similarly wirelessly couple any other suitable accessory 190 to the processing system 50.

Upon receiving feedback that an accessory 190 (e.g., any one of the accessories 190) has been communicatively coupled to the processing system 50, the processing system 50 may identify the type or version of the accessory 190 (e.g., at the block 242). For example, the processing system 50 may identify the type of projector 204 via communication with the integrated control circuitry 220 of the projector 204, which may be configured to transmit (e.g., wirelessly; via cooperation with the corresponding control board 226) information relating to a version, brand, and/or serial number of the projector 204 to the processing system 50.

As part of execution of the block 242, the processing system 50 may determine operational characteristics associated with the type of accessory 190 that is wirelessly coupled to the processing system 50. For example, for the projector 204, such operational characteristics may include types, quantities, and/or relative locations of the one or more lenses 222 included in the projector 204, a resolution and/or refresh rate of the projector 204, an output distortion factor of the projector 204, software versions (e.g., drivers) loaded on the integrated control circuitry 220 of the projector 204, amongst other features.

For example, in one embodiment, upon receiving a request from the processing system 50, the control board 226 of the projector 204 may provide the processing system 50 with feedback (e.g., digital data, wireless data) indicative of the operational characteristics of the projector 204. The processing system 50 may also access a database that stores the operational characteristics of various types and/or versions of projector 204 or of various types and/or versions of other accessories 190, and the processing system 50 may search the database by the type and/or version of the projector 204 or type and/or version of other accessory 190 to determine the operational characteristics of the projector 204 or the other accessory 190. Additionally or alternatively, the processing system 50 may send test signals (e.g., a wireless request) to the projector 204 and/or other accessory 190 to identify any one or combination of the aforementioned operational characteristics.

As a non-limiting example, the processing system 50 may send a test signal to determine the type of lens or lenses 222 included in the projector 204. In one embodiment, where the auxiliary accessory 206 includes an audio system, for example, the processing system 50 may communicate with the control board 226 of the auxiliary accessory 206 to determine a type, quantity, wattage, and/or relative arrangement of the speakers 218 that may be included in the audio system. Indeed, it should be appreciated that the processing system 50 may, upon receiving an indication that a particular accessory 190 has been wirelessly coupled to the processing system 50, execute the aforementioned techniques to determine a wide variety of operational characteristics of the accessory 190 in addition to, or in lieu of, the exemplary operational characteristics discussed herein.

In one embodiment, certain of the accessories 190 may be replaced or upgraded over time. For example, a user may replace the projector 204 with another projector (e.g., a new projector, a different projector) upon identification of a fault condition with the current projector 204. The fault condition may be identified by integrated control circuitry 220 of the projector 204 and/or by the control board 226 of the projector 204. An indication of the fault condition may be transmitted to the processing system 50 and/or the server 52, which may subsequently present the fault condition to the user via, for example, a message or alert displayed on the electronic device 120. Additionally or alternatively, the user may identify the fault condition via manual inspection of the projector 204 (e.g., upon a determination that the projector 204 is no longer adequately displaying amusement content). Still further, the projector 204 may be replaced with another (e.g., different) projector 204 upon a determination that the projector 204 has exceeded a corresponding operational life or service life (e.g., upon operation of a predetermined amount of operating hours of the projector 204 or components of the projector 204). In any such scenario, the user may remove (e.g., decouple) the accessory 190 from the attraction 200 and install a corresponding replacement accessory 190 on the attraction 200. Upon installation of the replacement accessory 190 (e.g., the replacement projector 204), the user may operate the accessory 190 to establish a wireless communication link between the accessory 190 and the processing system 50, for example. Accordingly, the processing system 50 may proceed to identify the newly linked accessory 190 in accordance with the aforementioned techniques.

In one embodiment, upon identification of the type of accessory 190 (e.g., the replacement projector 204) currently coupled (e.g., wirelessly coupled; linked) to the processing system 50 at the block 242, the processing system 50 may adjust (e.g., modify) the amusement content received from the server 52 based on the identified type of the accessory 190 (and/or characteristics thereof) and prior to transmission of the amusement content to the accessory 190, as indicated by block 244. For example, during operation of the attraction 200, the server 52 may generate and output a first data stream to the processing system 50 that includes control instructions useful for presenting amusement content to the user 76 via one or more of the accessories 190. The first data stream may include control instructions (e.g., first transmission parameters) for presenting amusement content (e.g., AR/VR content) to the user via the wearable visualization device 12, control instructions for presenting amusement content (e.g., images, video) to the user 76 via the projector 204, and/or control instructions for presenting amusement content (e.g., haptic feedback, audio output) to the user 76 via the auxiliary accessory 206. Based on information relating to the identified type of the accessory 190 (e.g., and/or characteristics thereof; as determined at block 242), the processing system 50 may modify one or more of the control instructions in the first data stream received from the server 52 to generate a second data stream (e.g., a modified data stream), and may subsequently transmit the second data stream (including second transmission parameters different from the first transmission parameters) to the corresponding accessories 190, as indicated by block 246. To this end, the processing system 50 may convert the first data stream to a format (e.g., the format of the second data stream) that, when received by the corresponding accessory 190, enables the corresponding accessory 190 to more suitably output the amusement content to the user 76 (e.g., as compared to when the corresponding accessory 190 receives the first data stream from the server 52).

For example, in one embodiment, the server 52 may output a data stream of amusement content that includes visual features to be presented to the user 76 by the projector 204 at a first resolution and/or a first refresh rate (e.g., 90

Hz). Additionally or alternatively, the server 52 may output a data stream of amusement content that includes audio files to be output by the speakers 218 of the auxiliary accessory 206 in a first audio configuration (e.g., surround sound). The processing system 50 may determine (e.g., at block 242) that the projector 204 includes display components configured to operate at a second resolution and/or a second refresh rate (e.g., 60 Hz), which may be different than the first resolution and/or the first refresh rate of the data stream provided by the server 52.

Further, the processing system 50 may determine (e.g., at block 242) that the auxiliary accessory 206 includes a speaker arrangement configured to output sound in a second audio configuration (e.g., mono), which may be different than the first audio configuration in the data stream provided by the server 52. In such embodiments, the processing system 50 may adjust or modify (e.g., locally on the intermediate processor 60) the data stream received by the server 52 and output a modified data stream having visual features presented at the second resolution and/or the second refresh rate to the projector 204, and/or having audio files to be output by the speakers 128 of the auxiliary accessory 206 in the second audio configuration.

To this end, the processing system 50 may modify the data stream received from the server 52 to have a format that is more suitable for usage by the components of the projector 204 (e.g., a display system of the projector 204) and/or the speakers 218 of the auxiliary accessory 206, for example, prior to transmission of the data stream to the projector 204 and/or to the auxiliary accessory 206. Indeed, it should be understood that the processing system 50 may, based on the determined operational characteristics of any one of the accessories 190, adjust multiple parameters (e.g., control instructions) of the amusement content data stream received from the server 52 prior to transmission of the amusement content data stream to the corresponding accessories 190 (e.g., to the control boards 226 of the accessories 190).

Additionally or alternatively to execution of the block 244, the processing system 50 may, upon execution of the block 242, instruct the server 52 to generate a modified data stream that includes adjusted amusement content, where the adjustment amusement contentment is determined based on the identified type of accessory 190 or accessories 190 (and/or characteristics thereof) communicatively currently coupled to the processing system 50, as indicated by block 248. That is, the processing system 50 may instruct the server 52 to adjust or modify generation of at least one aspect of the data stream of amusement content generated by the server 52 prior to transmission of the data stream from the server 52 to the processing system 50. In other words, the processing system 50 may instruct the server 52 to remotely adjust generation and/or modify generation of at least an aspect of the amusement content based on the identified type of a corresponding accessory 190 (and/or the characteristics thereof), instead of adjusting the aspect locally via, for example, the intermediate processor 60 of the processing system 50.

For example, upon determining the particular operational characteristics (e.g., display resolution and/or refresh rate) of the projector 204 at the block 242, or determining particular operational characteristics of the auxiliary accessory 206 (e.g., a speaker configuration of the speakers 128), the processing system 50 may instruct the server 52 to output a data stream of amusement content in a format (e.g., display resolution, refresh rate; audio format) that corresponds to the particular operational characteristics of the projector 204 and/or auxiliary accessory 206. In one embodiment, based on the determined operational characteristics of the projector 204 and/or the determined operational characteristics of the auxiliary accessory 206, the processing system 50 may instruct the server 52 to include additional data or fewer data in the data stream of amusement content output by the server 52. In this manner, the processing system 50 may facilitate efficient transmission of data (e.g., via the communication circuitry 75) suitable for effective operation of the projector 204 and/or the auxiliary accessory 206, while omitting or reducing transmission of data which may not be usable or not effectively useable by the particular components included in the projector 204 and/or the auxiliary accessory 206, for example. This may reduce latency in the presentation of amusement content to the user 76 via the projector 204 and/or the auxiliary accessory 206.

In one embodiment, the processing system 50 may instruct the server 52 to adjust the type of modeling algorithm used to generate the data stream of the amusement content based on a detected version of software and/or drivers loaded onto, for example, the integrated circuitry 220 or the control board 226 of the wearable visualization device 12, the integrated circuitry 220 or the control board 226 of the projector 204, and/or the integrated circuitry 220 or the control board 226 of the auxiliary accessory 206. In one embodiment, the integrated circuitry 220 of the projector 204 or the control board 226 of the projector 204 may, upon communicative coupling (e.g., wireless coupling) to the processing system 50, upload drivers, programs, or other data to the server 52 for usage by the server 52 during generation of the amusement content for the projector 204. As an example, the integrated circuitry 220 and/or the control board 226 of the projector 204 may upload drivers and/or control algorithms to the server 52 that may enable the server 52 to generate additional amusement content and/or adjusted amusement content for output by the projector 204. The processing system 50 may operate in a manner that results in default modeling algorithms being used while the type or other features of the accessory 190 that is connected (e.g., linked to the processing system 50) cannot be determined (e.g., is unrecognized and/or unknown).

With reference to FIG. 4, the control board 226 of the projector 204 may include a sensor 260 (e.g., or a plurality of sensors 260) that is configured to detect and generate signals indicative of location parameters of the projector 204. The location parameters may be indicative of a location and/or orientation of the projector 204 relative to features of the attraction 200, such as distance at which the projector 204 is positioned from the object 210 onto which the projector 204 is configured to project amusement content. For example, the sensor 260 may include one or more GPS sensors configured to monitor a location of the projector 204 in a coordinate plane, one or more light detection and ranging (LIDAR) sensors configured to monitor a distance between a component (e.g., the lens 222) of the projector 204 and an object (e.g., the object 210), or another suitable sensor or sensor array. The processing system 50 and/or the server 52 may receive feedback indicative of the location parameters of the projector 204 and adjust output of the amusement content data stream to the projector 204 based on the location parameters.

For example, upon receiving an indication from the sensor 260 indicating that a location parameter of the projector 204 has changed, the processing system 50 may locally (e.g., on the intermediate processor 60) adjust output of the amusement content data stream provided to the projector 204, and/or may instruct the server 52 to generate alternate amusement content based on the adjusted location parameter(s). As an example, the processing system 50 may effectuate adjustment of a distortion of the visual images included in the amusement content data stream provided to the projector 204 such that, when projected onto the object 210, the visual features remain spatially accurate (e.g., the visual features are not distorted based on movement of the projector 204 from an initial location to a new location relative to the object 210).

With reference to FIG. 4, one or more of the accessories 190 may be coupled (e.g., physically coupled) to a mobile assembly 270 that may be moveable (e.g., via dedicated wheels or tracks; via loading onto a transportation device) between various locations (e.g., different areas of an amusement park; various show sites). The mobile assembly 270 may include frame or enclosure that houses components sufficient to enable stand-alone operation of the accessories 190. For example, the mobile assembly 270 may include a power source 272 that is suitable to provide electrical power for operation of the accessories 190 in accordance with the presently disclosed techniques. Additionally or alternatively, the mobile assembly 270 may include a plug 274 (e.g., a connection port) that enables the mobile assembly 270 to receive power (e.g., electrical power) from an auxiliary power unit 276 (e.g., a generator, a power grid).

In any case, in this manner, the mobile assembly 270 may be transported to a desired location to provide amusement content to one or more guests (e.g., the user 76) utilizing the accessories of the mobile assembly 270 (e.g., wearing the wearable visualization device 12; viewing content displayed by the projector 204). As the accessories 190 are configured to wirelessly couple to the processing system 50 and/or the server 52 in accordance with the presently disclosed techniques, the processing system 50 and/or the server 52 may be located at a location remote from the mobile assembly 270. That is, the mobile assembly 270 may be transported to various desired locations and the one or more accessories 190 may be linked (e.g., communicatively coupled; wirelessly coupled) with the processing system 50 and/or the server 52, such that the one or more accessories 190 may provide amusement content to guests without involving relocation of the processing system 50 and/or the server 52.

As set forth above, embodiments of the present disclosure may provide one or more technical effects useful for tailoring or otherwise adjusting output of amusement content by a server, based on one or more operational characteristics of an accessory that may be communicatively coupled to the server and configured to receive the amusement content, to facilitate more effective presentation of the amusement content to the user during the course of the amusement park attraction. It should be understood that the technical effects and technical problems in the specification are examples and are not limiting. Indeed, it should be noted that the embodiments described in the specification may have other technical effects and can solve other technical problems.

While the embodiments set forth in the present disclosure may be susceptible to various modifications and alternative forms, specific embodiments have been shown by way of example in the drawings and have been described in detail herein. However, it should be understood that the disclosure is not intended to be limited to the particular forms disclosed. The disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A content processing system for an amusement park attraction, the content processing system comprising:

a processor configured to:

receive a data stream including one or more control instructions for output of amusement content;

receive feedback from an accessory, wherein the feedback is indicative of one or more content output characteristics of the accessory, and the one or more content output characteristics comprise display resolution, display refresh rate, audio format, or a combination thereof;

identify the one or more content output characteristics of the accessory based on the feedback;

based on the one or more content output characteristics, effectuate modification of the data stream to generate a modified data stream including one or more updated control instructions for output of adjusted amusement content to be presented to a user via the accessory; and transmit the modified data stream to the accessory.

2. The content processing system of claim 1, comprising the accessory, wherein the accessory comprises a first communication component, wherein the processor is communicatively coupled to a second communication component, and wherein the first communication component and the second communication component enable the processor to transmit the modified data stream to the accessory via wireless transmission of the modified data stream to the accessory.

3. The content processing system of claim 2, comprising a control board having the first communication component, wherein the control board is removably coupled to integrated control circuitry of the accessory.

4. The content processing system of claim 1, wherein the accessory comprises a projector configured to project the adjusted amusement content onto an object of the amusement park attraction.

5. The content processing system of claim 1, wherein the accessory comprises a wearable visualization device configured to be worn by the user and overlay the adjusted amusement content onto a line of sight of the user.

6. The content processing system of claim 1, wherein the accessory comprises an audio system configured to output audio indicative of the adjusted amusement content.

7. The content processing system of claim 1, comprising a server configured to generate the data stream, wherein the processor is configured to receive the data stream from the server, wherein, to effectuate modification of the data stream, the processor is configured to adjust, based on the one or more content output characteristics, the one or more control instructions included in the data stream received from the server to generate the one or more updated control instructions of the modified data stream.

8. The content processing system of claim 1, comprising a server configured to generate the data stream, wherein the processor is configured to receive the data stream from the server, wherein, to effectuate modification of the data stream, the processor is configured to:

instruct the server to adjust, based on the one or more content output characteristics, the one or more control instructions included in the data stream to generate the one or more updated control instructions of the modified data stream; and receive the modified data stream from the server.

9. An attraction system, comprising:

an accessory comprising a sensor configured to acquire feedback indicative of one or more content output characteristics of the accessory, wherein the one or more content output characteristics comprise display resolution, refresh rate, audio format, or a combination thereof;

a server configured to generate a data stream including amusement content; and a processing system configured to:

identify the one or more content output characteristics of the accessory based on the feedback;

based on the one or more content output characteristics of the accessory, effectuate modification of the data stream to generate a modified data stream including adjusted amusement content to be output to a user via the accessory; and transmit the modified data stream to the accessory.

10. The attraction system of claim 9, wherein the accessory comprises a mobile assembly having one or more visual output devices, one or more audio output devices, one or more haptic output devices, or a combination thereof, configured to output the adjusted amusement content to the user.

11. The attraction system of claim 9, wherein the one or more content output characteristics comprise at least one characteristic corresponding to a type of the accessory and, to effectuate modification of the data stream, the processing system is configured to adjust, based on the type of the accessory, one or more control instructions included in the data stream received from the server to generate the modified data stream.

12. The attraction system of claim 9, wherein the one or more content output characteristics comprise at least one characteristic corresponding to a type of the accessory and, to effectuate modification of the data stream, the processing system is configured to:

instruct the server to adjust, based on the type of the accessory, one or more control instructions included in the data stream to generate the modified data stream; and receive the modified data stream from the server.

13. The attraction system of claim 9, wherein the accessory is coupled to a mobile assembly that is transportable to a plurality of locations, and wherein the server is located at a location that is remote from the mobile assembly.

14. A method for operating a processing system of an attraction, the method comprising:

generating, via a server, a data stream of amusement content, wherein the data stream of amusement content is configured to be output by a first accessory for presentation to a user;

communicatively coupling a second accessory to the processing system;

obtaining feedback from the second accessory, wherein the feedback is indicative of one or more content output characteristics of the second accessory, and the one or more content output characteristics comprise display resolution, display refresh rate, audio format, or a combination thereof;

identifying, via the processing system, the one or more content output characteristics of the second accessory based on the feedback;

based on the one or more content output characteristics of the second accessory, effectuating modification of the data stream to generate a modified data stream including adjusted amusement content to be output by the second accessory for presentation to the user; and transmitting, via the processing system, the modified data stream to the second accessory.

15. The method of claim 14, further comprising:

projecting, via the second accessory, the adjusted amusement content onto an object, wherein the second accessory comprises a projector;

identifying, via the processing system, an adjustment in a location of the projector, wherein the one or more content output characteristics comprise at least one characteristic corresponding to the location; and effectuating modification of the data stream based on the adjustment in the location to generate the modified data stream.

16. The method of claim 14, further comprising:

coupling a control board to the second accessory, wherein the control board comprises a first communication component configured to communicate with integrated control circuitry of the second accessory; and linking the first communication component to a second communication component of the processing system to enable wireless transmission of the modified data stream from the processing system to the second accessory.

17. The method of claim 14, wherein effectuating modification of the data stream comprises:

receiving, at the processing system, the data stream from the server; and adjusting, via the processing system, one or more control instructions included in the data stream received from the server to generate the modified data stream.

18. The method claim 14, wherein effectuating modification of the data stream comprises:

instructing, via the processing system, the server to adjust one or more control instructions included in the data stream to generate the modified data stream; and receiving, at the processing system, the modified data stream from the server.

19. The content processing system of claim 1, wherein the feedback is indicative of the display resolution, and the modified data stream includes the one or more updated instructions for output of the adjusted amusement content according to the display resolution.

20. The content processing system of claim 1, wherein the processor is configured to send a test signal to the accessory to identify the one or more content output characteristics of the accessory and the feedback comprises a response to the test signal.

* * * * *